United States Patent [19]

Rangaswamy et al.

[11] Patent Number: 4,692,305

[45] Date of Patent: Sep. 8, 1987

[54] CORROSION AND WEAR RESISTANT ALLOY

[75] Inventors: Subramaniam Rangaswamy, Port Jefferson Station; John H. Harrington, Warwick, both of N.Y.

[73] Assignee: Perkin-Elmer Corporation, Norwalk, Conn.

[21] Appl. No.: 795,057

[22] Filed: Nov. 5, 1985

[51] Int. Cl.[4] ..... C22C 19/05; C22C 19/07; C22C 30/00

[52] U.S. Cl. ..... 420/436; 148/403; 420/439; 420/442; 420/443; 420/451; 420/453; 420/454; 420/587; 420/588

[58] Field of Search ..... 148/403; 420/436, 442, 420/443, 457, 587, 588, 439, 451, 452, 453, 454; 75/254

[56] References Cited

U.S. PATENT DOCUMENTS

| | | | |
|---|---|---|---|
| 2,868,639 | 1/1959 | Gonser, Jr. | 420/453 |
| 2,875,043 | 2/1959 | Tour | 420/457 |
| 2,936,229 | 5/1960 | Shepard | 420/588 |
| 2,938,787 | 5/1960 | Boyd et al. | 420/442 |
| 3,145,287 | 8/1964 | Siebein et al. | 219/75 |
| 3,305,326 | 2/1967 | Longo | 75/254 |
| 3,820,961 | 6/1974 | Zelahy | 75/254 |
| 4,043,810 | 8/1977 | Acuncius et al. | 420/443 |
| 4,116,682 | 9/1978 | Polk et al. | 420/588 |
| 4,288,247 | 9/1981 | Shaw | 420/588 |
| 4,430,297 | 2/1984 | Crook | 420/587 |
| 4,473,402 | 9/1984 | Ray et al. | 148/403 |
| 4,476,091 | 10/1984 | Klarstrom | 420/443 |
| 4,480,016 | 10/1984 | Henschel | 148/403 |

FOREIGN PATENT DOCUMENTS

| | | | |
|---|---|---|---|
| 525559 | 5/1956 | Canada | 420/442 |
| 588233 | 12/1959 | Canada | 420/442 |
| 9881 | 1/1984 | European Pat. Off. . | |
| 102540 | 8/1981 | Japan | 420/442 |
| 136473 | 8/1984 | Japan | 420/442 |
| 867455 | 5/1961 | United Kingdom . | |

*Primary Examiner*—L Dewayne Rutledge
*Assistant Examiner*—Robert L. McDowell
*Attorney, Agent, or Firm*—H. S. Ingham; F. L. Masselle; E. T. Grimes

[57] ABSTRACT

A novel alloy is disclosed which is characterized by high resistance to wear and corrosion. The alloy consists essentially of 2 to 25% chromium, 5 to 30% molybdenum, 3 to 15% tungsten, 2 to 8% copper, 2 to 8% boron, and 0.2 to 2% carbon; the balance being incidental impurities and at least 30% of a metal selected from the group consisting of nickel, cobalt and combinations thereof, with the total of molybdenum and tungsten being at least 16%. The alloy is preferably in the form of a powder for thermal spraying, and coating produced thereby generally have an amorphous structure.

12 Claims, No Drawings

CORROSION AND WEAR RESISTANT ALLOY

This invention relates to an amorphous alloy composition characterized by improved wear and corrosion resistance and to a process for thermal spraying such alloy.

BACKGROUND OF THE INVENTION

Certain alloys of nickel and cobalt may exist in an amorphous form. They contain nickel, cobalt and/or iron and specified proportions of such elements as molybdenum and/or tungsten, and boron, silicon and/or carbon. The alloys are prepared with the amorphous structure by rapid quenching from the melt. For example amorphous ribbon may be produced by quenching a stream of molten alloy on a chilled surface as described in U.S. Pat. No. 4,116,682. A practical method of processing such alloys into a directly useful form is by thermal spraying to produce a coating.

Thermal spraying, also known as flame spraying, involves the heat softening of a heat fusible material such as metal or ceramic, and propelling the softened material in particulate form against a surface which is to be coated. The heated particles strike the surface where they are quenched and bonded thereto. A conventional thermal spray gun is used for the purpose of both heating and propelling the particles. In one type of thermal spray gun, the heat fusible material is supplied to the gun in powder form. Such powders are typically comprised of small particles, e.g., between 100 mesh U.S. Standard screen size (149 microns) and about 2 microns. A thermal spray gun normally utilizes a combustion or plasma flame to produce the heat for melting of the powder particles. It is recognized by those of skill in the art, however, that other heating means may be used as well, such as electric arcs, resistancme heaters or induction heaters, and these may be used alone or in combination with other forms of heaters. In a powder-type combustion thermal spray gun, the carrier gas, which entrains and transports the powder, can be one of the combustion gases or an inert gas such as nitrogen, or it can be simply compressed air. In a plasma spray gun, the primary plasma gas is generally nitrogen or argon. Hydrogen or helium is usually added to the primary gas. The carrier gas is generally the same as the primary plasma gas, although other gases, such as hydrocarbons, may be used in certain situations.

The material alternatively may be fed into a heating zone in the form of a rod or wire. In the wire type thermal spray gun, the rod or wire of the material to be sprayed is fed into the heating zone formed by a flame of some type, such as a combustion flame, where it is melted or at least heat-softened and atomized, usually by blast gas, and thence propelled in finely divided form onto the surface to be coated. In an arc wire gun two wires are melted in an electric arc struck between the wire ends, and the molten metal is atomized by compressed gas, usually air, and sprayed to a workpiece to be coated. The rod or wire may be conventionally formed as by drawing, or may be formed by sintering together a powder, or by bonding together the powder by means of an organic binder or other suitable binder which disintegrates in the heat of the heating zone, thereby releasing the powder to be sprayed in finely divided form.

A class of materials known as self-fluxing alloys are quite common for hard facing coatings produced by such methods as thermal spraying. These alloys of nickel or cobalt contain boron and silicon which act as fluxing agents during processing and hardening agents in the coating. Usually self-fluxing alloys are applied in two steps, vis. thermal sprayed in the normal manner and then fused in situ with an oxyacetylene torch, induction coil, furnace or the like, the fluxing agents making the fusing step practical in open air. However, the alloys may also be thermal sprayed with a process such as plasma spraying without requiring the fusing step, but the coatings are not quite as dense or wear resistant. Generally self-fluxing alloy coatings are used for hard surfacing to provide wear resistance, particularly where a good surface finish is required.

A typical self-fluxing alloy composition of nickel or cobalt contains chromium, boron, silicon and carbon. An alloy may additionally contain molybdenum, tungsten and/or iron. For example U.S. Pat. No. 2,868,639 discloses an alloy for hard surface composed of (by weight) 7 to 17% chromium, 1 to 4.5% boron, 1 to 5.5% silicon, 0.1 to 5.5% iron, 6 to 20% of at least one of tungsten and molybdenum, 0.05 to 2.5% carbon, the remainder nickel and incidental impurities. U.S. Pat. No. 2,936,229 discloses a cobalt alloy containing 1.5 to 4% boron, 0 to 4% silicon, 0 to 3% carbon, 0 to 20% tungsten and 0 to 8% molybdenum.

U.S. Pat. No. 2,875,043 claims a spray-weldable alloy containing at least 40% nickel, 1 to 6% boron, silicon up to about 6%, 3 to 8% copper and 3 to 10% molybdenum. Tungsten is not included.

Some of the self-fluxing alloys have been in use commercially for more than 25 years and have been quite successful. These alloys have melting ranges around 1075 degrees Centigrade and hot hardness is lost at a temperature as low as 650 degrees; therefore self-fluxing alloys are not useful at high temperature. Also, if very high wear resistance is needed a carbide such as tungsten carbide is added as described, for example, in British Patent Specification No. 867,455. Carbides are expensive and make the coatings difficult to grind finish, harder to fuse and less resistant to corrosion.

European Patent Specification No. 0 009 881 (published Jan. 11, 1984) involves an alloy composition of at least 48% cobalt, nickel and (if present) iron; 27 to 35% chromium; 5 to 15% molybdenum and/or tungsten; 0.3 to 2.25% carbon and/or boron; 0 to 3% silicon and/or manganese; 0 to 5% titanium and the like; 0 to 5% copper; and 0 to 2% rare earths. There are, however, certain restrictions including that if there is 2% or more of carbon and/or boron present, there is more than 30% chromium present.

More than 10% iron is preferred. Also, preferably no boron is present or, if it is present, it should not constitute more than 1% of the composition; and further limitations on boron are indicated where a significant amount of carbon is present.

U.S. Pat. No. 4,116,682 describes a class of amorphous metal alloys of the formula MaTbXc wherein M may be iron, cobalt, nickel and/or chromium, T may include molybdenum and tungsten and X may include boron and carbon. The latter group X of boron, etc. has a maximum of 10 atomic percent which calculates to about 1.9% by weight maximum for boron in the amorphous alloys; thus boron is characteristically low compared to the boron content in self-fluxing type of alloys, although there is some overlap. One typical amorphous composition is (by atomic percent) 58 nickel, 25 chromium, 2 iron, 5 molybdenum, 3 tungsten, 4 boron, 3 carbon. As weight percent this is (approximately) 22% chromium, 1.8% iron, 8% molybdenum, 10% tungsten, 0.7 boron, 0.7 carbon, balance nickel.

The amorphous types of compositions are of growing interest for the combined properties of corrosion resistance, frictional wear resistance and abrasive wear resistance. However, further improvements in these properties are desired.

In view of the foregoing, a primary object of the present invention is to provide a novel alloy composition characterized by the combination of corrosion resistance, frictional wear resistance and abrasive wear resistance.

A further object of this invention is to provide an improved amorphous type of alloy for the thermal spray process.

Another object is to provide an improved thermal spray process for producing corrosion and wear resistant coatings.

BRIEF DESCRIPTION OF THE INVENTION

The foregoing and other objects are achieved by an alloy composition of, as percent by weight:

2 to 25% chromium,
5 to 30% molybdenum,
3 to 15% tungsten,
2.0 to 8% copper,
0.2 to 2.0% boron, and
0.2 to 2.0% carbon;

the balance being incidental impurities and at least 30% of a metal selected from the group consisting of nickel, cobalt and combinations thereof, with the total of molybdenum and tungsten being at least 16%.

DETAILED DESCRIPTION OF THE INVENTION

According to the present invention, an alloy material has been developed which has a high degree of resistance to both wear and corrosion. The alloy is especially suitable for thermal spraying onto metallic substrates by conventional thermal spray equipment, and the coatings optionally may be subsequently fused.

The alloy composition of the present invention is broadly in the ranges of, by weight:

2 to 25% chromium,
5 to 30% molybdenum,
3 to 15% tungsten,
2.0 to 8% copper,
0.2 to 2.0% boron, and
0.2 to 2.0% carbon; the balance being incidental impurities and at least 30% of a metal selected from the group consisting of nickel, cobalt and combinations thereof; the total of molybdenum and tungsten being at least 16%.

Preferably the ranges are as follows:

15 to 23% chromium,
5 to 20% molybdenum,
5 to 12% tungsten,
3.0 to 5% copper,
0.5 to 1.5% boron, and
0.5 to 1.5% carbon;

the balance nickel and incidental impurities, with the total of molybdenum and tungsten being at least 16%.

In order to maintain maximum corrosion resistance, total content of iron should be kept to a minimum value and should be generally less than 1.0% by weight and preferably less than 0.5%.

Nickel is generally preferable but cobalt may be substituted partially or fully to provide specific coating performance benefits depending upon service requirements such as resistance to certain high temperature corrosive conditions.

Optional elements that may be included in the composition are zirconium, tantalum, niobium, titanium, vanadium and hafnium, totalling less than about 7% by weight to form carbides and further improve corrosion resistance. Other optional elements may be silicon, manganese, phosphorous, germanium and arsenic, totalling less than about 3% to reduce melting point where desired; and rare earth elements such as yttrium and/or cerium totalling less than about 2% for additional oxidation resistance. Otherwise incidental impurities should be less than about 2% and preferably 0.5%.

It is important that chromium not exceed about 25% because a higher percentage renders the alloy brittle and poor in impact resistance.

Although the composition of the present invention may be quite useful as a quenched powder or ribbon or the like, it is especially suitable for application as a coating produced by thermal spraying.

As a thermal spray material the composition should be in alloy form (as distinct from a composite of the constituents) since the desirable benefit is obtained with the maximum homogeneity available therefrom. Alloy powder of size and flowability suitable for thermal spraying is one such form. Such powder should fall in a range between 100 mesh (U.S. standard screen size) (149 microns) and about 2 microns. For example, a coarse grade may be −140 +325 mesh (−105 +44 microns) and a fine grade may be −200 +400 mesh (−74+37 microns).

When used for thermal spraying the starting alloy material need not have the amorphous structure and may even have the ordinary macrocrystalline structure resulting from the normal cooling rates in the usual production procedure. Thus the thermal spray powder may be made by such standard method as atomizing from the melt and cooling the droplets under ambient condition. The thermal spraying process then melts the particles and provides a quenched coating that may be amorphous. By using the usual manufacturing procedures the production of the thermal spray powder is kept relatively simple and coats are minimized. Also, the atomized powder has much better flowability than amorphous powder formed, for example, by crushing quenched ribbon.

The powders are sprayed in the conventional manner, using a powder-type thermal spray gun, though it is also possible to combine the same into the form of a composite wire or rod, using plastic or a similar binder, as for example, polyethylene or polyurethane, which decomposes in the heating zone of the gun. Alloy rods or wires may also be used in the wire thermal spray processes. The rods or wires should have conventional sizes and accuracy tolerances for flame spray wires and thus, for example, may vary in size between 6.4 mm and 20 gauge.

Alloy coatings of the present invention are particularly dense and low in oxide content, and show significant improvements in both wear resistance and corrosion resistance over prior coatings. The coatings are excellently suited as bearing and wear surfaces on machine components, particularly where there are corrosive conditions as, for example, for coating petrochemical production equipment such as pump plungers, sucker rod couplings, sleeves, mud pump liners, and compressor rods; the circumference of automotive and diesel engine piston rings and cylinder walls; the interior surface of flue gas scrubbers for power generation and process industries; pulp and paper processing equipment such as digestors, de-barking machines, and recovery boilers; glass manufacturing equipment such as molds, mold plates, plungers, and neck rings; electric power generation boiler water walls, slope tubes, control valves, and pump components; gas turbine engine components such as nozzles and stator vane segments; machine ways; printing rolls; electroplating fixtures; rotary engine trochoids, seals and end plates; engine crankshafts; roll journals; bearing sleeves; impeller shafts; gear journals; fuel pump rotors; screw conveyors; wire or thread capstans; shifter forks; doctor blades; farming tools; motor shafts; lathe and grinder centers; cam followers.

EXAMPLE

An alloy powder of the following composition by weight was prepared by nitrogen atomization from the melt:

21.3% chromium
8.8% molybdenum
10.7% tungsten,
2.9% copper,
0.06% iron,
0.6% boron,
0.8% carbon,
balance nickel and incidental impurities.

The powder was sized to about −140 +325 mesh (−105 +44 microns) and had the normal macrocrystalline structure. It was thermal sprayed with a plasma gun of the type described in U.S. Pat. No. 3,145,287 and sold by METCO as Type 7MB with a #6 powder port and GP nozzle, using the following parameters: argon gas at 6.7 bar pressure and 72 standard l/min flow, hydrogen secondary gas at 3.3 bar pressure and 9 l/min flow, arc at 80 volts and 500 amperes, powder feed rate 3 kg per hour using argon carrier gas at 15 scfh, and spray distance 15 cm. A pair of air cooling jets parallel and adjacent to the spray stream were used. Substrate was cold rolled steel prepared by grit blasting in the normal manner.

Coatings up to 1.3 mm thick were produced that were substantially amorphous (about 70%) according to X-ray diffraction measurements. Porosity was less than about 0.5%, and oxide content was less than about 2.0%. Macrohardness was Rc 43; microhardness averaged DPH(300) 575.

The amorphous coatings of the example were tested for corrosion resistance by removing the coatings from the substrates and exposing them to several acid solutions at for 3 hours. Comparison with a similar but state-of-the-art alloy is given in Table 1 for the several different acids.

TABLE 1

| Acid Solution | Temp. (°C.) | CORROSION RATE (mm/year) Example | State-of-Art* |
|---|---|---|---|
| Sulfuric (25%) | 80 | 0.5 | 392 |
| Hydrochloric (10%) | 25 | 12 | 48 |
| Nitric (10%) | 25 | 30 | 59 |

*22% Cr, 8% Mo, 10% W, 1.8% Fe, 0.7 B, 0.7 C, balance Ni.

Abrasive wear resistance for the above example according to the present invention was measured by placing coated samples in sliding motion against a cast iron plate with a slurry of 150 gms of between 53 and 15 micron aluminum oxide abrasive powder in 500 ml of water. A load of 3.3 kg/cm was applied and the surface motion was about 122 cm/sec for 20 minutes. Coating loss was determined. The as-sprayed coating of the example showed a wear resistance of about 85% of that of a fused coating thermal sprayed of AMS 4775A which is considered an industry standard.

Sliding wear resistance for the alloy of the example was determined with an Alpha LFW-1 friction and wear testing machine sold by Fayville-Levalle Corp., Downers Grove, Ill., using a 3.5 cm diameter test ring and 45 kg load at 197 RPM for 12,000 revolutions.

Results in comparison to molybdenum thermal sprayed with the wire process are set forth in Table 2; such molybdenum coatings are used virtually universally on automotive piston compresssion rings. The data show improved wear, including a substantial improvement in the wear of the ring surface of cast iron.

TABLE 2

| | Example 1 | Molybdenum |
|---|---|---|
| Ring surface: hard steel Rc 60 | | |
| Average friction | 0.17 | 0.15 |
| Coating wear (scar width, mm) | 0.9 | 1.2 |
| Ring wear (weight loss, mg) | 0.9 | 1.2 |
| Ring surface: cast iron Rb 79 | | |
| Average friction | 0.13 | 0.16 |
| Coating wear (scar width, mm) | 0.8 | 1.0 |
| Ring wear (weight loss, mg) | 0.7 | 16.3 |

While the invention has been described above in detail with reference to specific embodiments, various changes and modifications which fall within the spirit of the invention and scope of the appended claims will become apparent to those skilled in this art. The invention is therefore only intended to be limited by the appended claims or their equivalents.

What is claimed is:

1. An alloy characterized by high resistance to wear and corrosion, consisting essentially of, as percent by weight:

2 to 25% chromium,
5 to 30% molybdenum,
3 to 15% tungsten,
2.0 to 8% copper,
0.2 to 2.0% boron, and
0.2 to 2.0% carbon;

the balance being incidental impurities and at least 30% of a metal selected from the group consisting of nickel, cobalt and combinations thereof; and the total of molybdenum and tungsten being at least 16%.

2. The alloy of claim 1 in the form of a thermal spray allow powder.

3. The alloy powder of claim 2 having a substantially crystalline structure.

4. An alloy characterized by high resistance to wear and corrosion, consisting essentially of, as percent by weight:

15 to 23% chromium,
5 to 20% molybdenum,
5 to 12% tungsten,
3.0 to 5% copper,
0.5 to 1.5% boron,
0.5 to 1.5% carbon, and
balance nickel and incidental impurities;

the total of molybdenum and tungsten being at least 16%.

5. The alloy of claim 4 in the form of a thermal spray alloy powder.

6. The alloy powder of claim 5 having a substantially crystalline structure.

7. The alloy of claim 1 or 4 wherein iron, if present, is less than 0.5%.

8. The alloy of claim 1 or 4 additionally including a total of up to 7% of one or more elements selected from the group consisting of zirconium, tantalum, niobium, titanium, vanadium and hafnium.

9. The alloy of claim 1 or 4 additionally including a total of up to 3% of one or more elements selected from the group consisting of silicon, manganese, phosphorous, germanium and arsenic.

10. The alloy of claim 1 or 4 additionally including a total of about 2% of rare earth elements.

11. A thermal spray powder of an alloy characterized by ability to produce coatings having high resistance to wear and corrosion, consisting essentially of, as percent by weight:

15 to 23% chromium,
5 to 20% molybdenum,
5 to 12% tungsten,
3.0 to 5% copper,
0.5 to 1.5% boron,
0.5 to 1.5% carbon, and
up to 0.5% iron;
up to 7% total of one or more first elements selected from the group consisting of zirconium, tantalum, niobium, titanium, vanadium and hafnium;
up to 3% total of one or more second elements selected from the group consisting of silicon, manganese, phosphorous, germanium, and arsenic;
up to 2% total of rare earth elements; and
balance nickel and incidental impurities;
the total of molybdenum and tungsten being at least 16%.

12. The thermal spray powder of claim 11 having a substantially non-amorphous structure.

* * * * *